US010273114B2

(12) United States Patent
Fishbeck

(10) Patent No.: US 10,273,114 B2
(45) Date of Patent: Apr. 30, 2019

(54) MULTI-SIDED WINDING

(71) Applicant: Precision, Inc., Minneapolis, MN (US)

(72) Inventor: Bruce D. Fishbeck, Minneapolis, MN (US)

(73) Assignee: Precision, Inc., Minneapolis, MN (US)

( * ) Notice: Subject to any disclaimer, the term of this patent is extended or adjusted under 35 U.S.C. 154(b) by 277 days.

(21) Appl. No.: 15/200,103

(22) Filed: Jul. 1, 2016

(65) Prior Publication Data

US 2018/0002132 A1 Jan. 4, 2018

(51) Int. Cl.
*B65H 59/38* (2006.01)
*B65H 54/64* (2006.01)

(52) U.S. Cl.
CPC ..... *B65H 59/387* (2013.01); *B65H 54/64* (2013.01); *B65H 2701/36* (2013.01)

(58) Field of Classification Search
CPC .. B65H 59/387; B65H 54/64; B65H 2701/36; H01F 27/2823; B29C 53/62; B29C 53/64; B29C 53/66; B29C 53/68; B29C 53/70; H02K 15/0081; H02K 15/02; H02K 15/03; H02K 15/04; H02K 15/0442; B21C 47/10; B21C 47/12
See application file for complete search history.

(56) References Cited

U.S. PATENT DOCUMENTS 3,669,380 A * 6/1972 Caltagirone ..... H01F 41/068 242/444.5
3,759,454 A * 9/1973 Bernard ..... H01R 43/033 242/439.1
3,895,423 A * 7/1975 Arakelov ..... H02K 1/165 29/650
4,884,759 A 12/1989 Nelle et al.
5,544,827 A 8/1996 Yano
6,161,032 A 12/2000 Acker
6,254,027 B1 7/2001 Kunou
6,622,954 B2 9/2003 Komuro et al.
6,978,962 B1 * 12/2005 Fore, Sr. ..... B65H 67/052 226/151
7,258,296 B2 8/2007 Smith et al.
7,614,579 B2 * 11/2009 Asano ..... H01F 41/082 242/437.3
7,626,478 B2 * 12/2009 Kawai ..... H01F 27/2847 335/299
8,500,657 B2 * 8/2013 Brown ..... A61M 25/09 600/585

(Continued)

OTHER PUBLICATIONS

Zhang, et al. "A Multielement RF Coil for MRI Guidance of Interventional Devices", Journal of Magnetic Resonance Imaging 14:56-62, 2001, 7 pages.

*Primary Examiner* — Michael E Gallion
(74) *Attorney, Agent, or Firm* — Brooks, Cameron & Huebsh, PLLC

(57) ABSTRACT

A method for winding can include positioning a multi-sided object on a winding component in a first position. The method can include dereeling a wire from a dereeler and winding onto the multi-sided object in the first position. The method can include rotating the winding component to position the multi-sided object in a second position without removing the multi-sided object from the winding component. The method can include dereeling the wire from the dereeler and winding onto the multi-sided object in the second position.

20 Claims, 4 Drawing Sheets

(56) References Cited

U.S. PATENT DOCUMENTS

| | | | | |
|---|---|---|---|---|
| 9,403,657 | B2 * | 8/2016 | Fishbeck | B65H 59/387 |
| 9,704,645 | B2 * | 7/2017 | Sugimoto | H01F 41/04 |
| 2001/0056232 | A1 | 12/2001 | Lardo et al. | |
| 2003/0163171 | A1 | 8/2003 | Kast et al. | |
| 2003/0209627 | A1 * | 11/2003 | Kawano | B65H 55/04 242/443 |
| 2006/0196984 | A1 * | 9/2006 | Higeta | H01F 27/2823 242/176 |
| 2007/0049846 | A1 | 3/2007 | Bown et al. | |
| 2007/0219618 | A1 | 9/2007 | Cully et al. | |
| 2008/0004598 | A1 | 1/2008 | Gilbert | |
| 2008/0251073 | A1 | 10/2008 | Jassell et al. | |
| 2009/0083968 | A1 | 4/2009 | Meinke | |
| 2009/0085710 | A1 | 4/2009 | Meinke | |
| 2009/0251271 | A1 | 10/2009 | Stelzer et al. | |
| 2009/0314418 | A1 * | 12/2009 | Uozumi | B29C 53/64 156/172 |
| 2010/0193065 | A1 | 8/2010 | Dye et al. | |
| 2010/0210939 | A1 | 8/2010 | Hartmann et al. | |
| 2015/0243436 | A1 * | 8/2015 | Kondo | H02K 15/085 29/605 |
| 2016/0002003 | A1 * | 1/2016 | Fishbeck | B65H 59/387 242/559.1 |
| 2018/0090953 | A1 * | 3/2018 | Hall | B66D 1/12 |

* cited by examiner

MULTI-SIDED WINDING

BACKGROUND

Winding devices are widely used and may include a diverse assortment of implementations and applications. For example, a reel of string, wire, and/or a filament can be dereeled and wound and/or turned onto an object. The filament can be wound onto the object by turning the object around a longitudinal axis of the object. The filament can be wound by winding the filament around the object. The winding can be performed under varying degrees of tension. High tension during winding can result in higher rigidity and strength whereas low tension can result in more flexibility. A filament can be wound onto an object in multiple layers. For example, a first layer can be wound across the object from left to right and then a second layer can be wound from right to left over the first layer.

DETAILED DESCRIPTION

Figure 1:
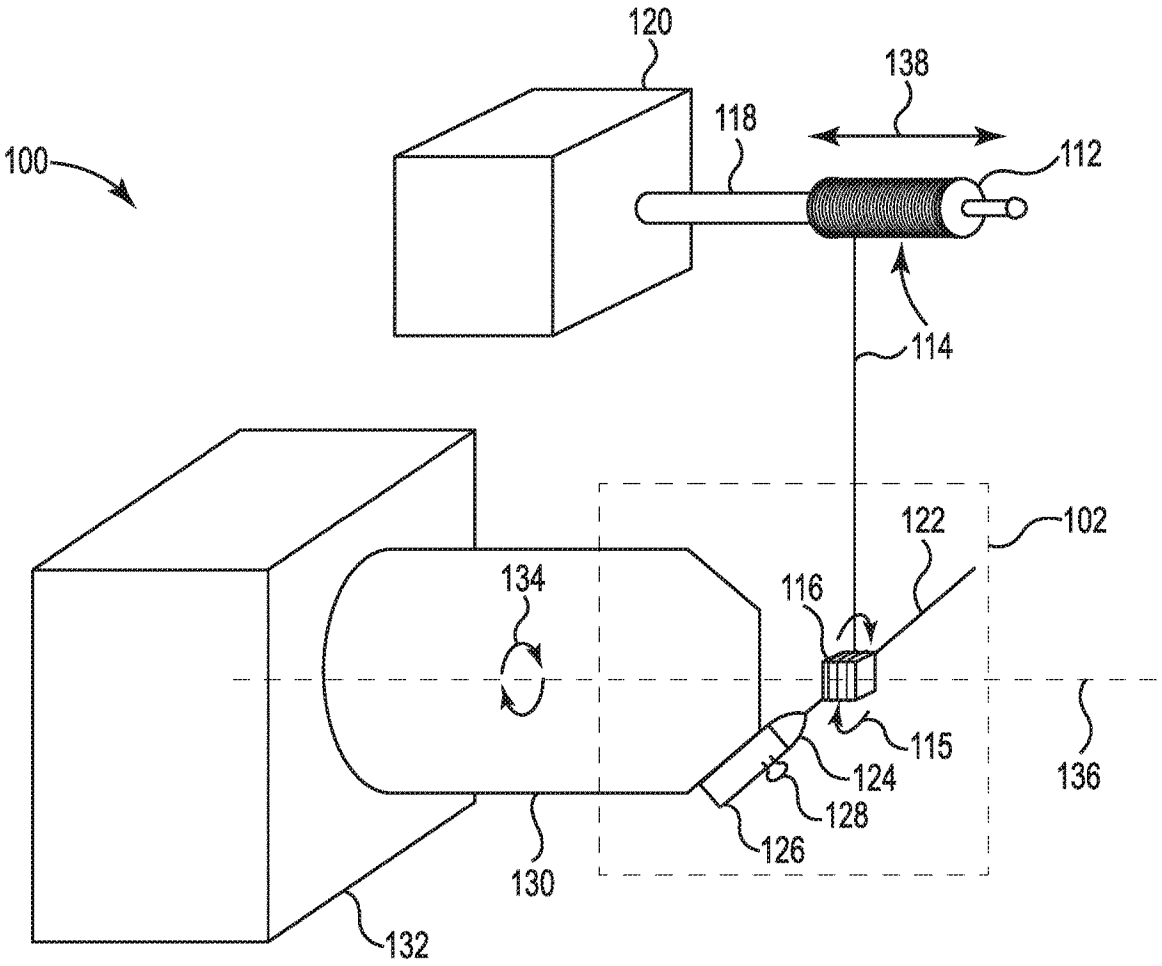
FIG. 1 is an illustration of an example of a system for multi-sided winding according to the present disclosure.

Winding a wire onto a multi-sided object (e.g., a cube) can be difficult as compared to winding a wire onto a single-sided object (e.g., a cylinder). Winding onto each of the sides of the multi-sided object can include repositioning the multi-sided object to be wound around. Winding the wire with a constant tension on the wire can allow the wire to maintain a location at a winding point along the multi-sided object and efficiently wind the wire by minimizing movement of the wire. The wire can be wound around a plurality (e.g., first set) of sides of a multi-sided object. For example, a wire can be wound around a first set of sides of a cube, such as four sides of the cube.

Further, the wire can be wound around all six sides of the cube by being wound around additional sets of sides of the cube. The winding of the wire around the six sides can include winding a wire in both directions across each of the six sides. For example, a wire can be wound around a first set of four sides of the cube. The cube can be repositioned and the wire can be wound around a second set of four sides of the cube, where the second set includes two sides of the first set. The cube can be repositioned again and the wire can be wound around a third set of four sides of the cube, where the third set includes two sides of the first set and two sides of the second set. See FIGS. 3A-4C for further description of how this occurs and FIGS. 4A-4C for what it looks like. While in some of the embodiments described below, the multi-sided object is a cube, embodiments are not so limited.

A multi-sided object with wire wound onto its multiple sides in loops around different axes can be useful for detection of movement, location, and/or orientation of the multi-sided object by electromagnetic sensing. For example, such detection can be useful for medical navigation purposes, such as movement through a physiological area (e.g. medically navigating a blood vessel, an esophagus, physiological tubing, etc.). Such detection can be useful for positioning purposes such as in virtual reality gaming, virtual positioning, positional detection, and other additional industries. Detection of movement, location, and/or orientation of the multi-sided object may be more difficult or inaccurate if wire were wound onto fewer sides of the multi-sided object and/or if the loops were wound around fewer axes of the multi-sided object. For example, precise movements of a multi-sided object used for medical navigation can include movements perpendicular to a longitudinal axis of the multi-sided object, along the longitudinal axis, and varying degrees of movement therebetween. Winding wire onto the multi-sided object in multiple directions and/or onto multiple sets of sides can provide an ability to detect movements in additional directions as compared to wire wound onto the multi-sided object in one direction and/or onto one set of sides. Methods for performing such medical navigation can include electromagnetic tracking and sensing for such medical procedures as guiding endoscopic tools and catheters down a pulmonary tract, radiation oncology to guide implantation of radiosurgical markers and/or fiducials, in addition to other medical uses.

In the following detailed description of the present disclosure, reference is made to the accompanying drawings that form a part hereof, and in which is shown by way of illustration how a number of embodiments of the disclosure may be practiced. These embodiments are described in sufficient detail to enable those of ordinary skill in the art to practice the embodiments of this disclosure, and it is to be understood that other embodiments may be utilized and that process, mechanical, and/or structural changes may be made without departing from the scope of the present disclosure. As used herein, "a number of" a particular thing can refer to one or more of such things (e.g., a number of windings can refer to one or more windings).

The figures herein follow a numbering convention in which the first data unit or data units correspond to the drawing figure number and the remaining data units identify an element or component in the drawing. Similar elements or components between different figures may be identified by the use of similar data units. For example, 122 may reference element "22" in FIG. 1, and a similar element may be referenced as 222 in FIG. 2, 322 in FIGS. 3A-3C, and 422 in FIGS. 4A-4C. As will be appreciated, elements shown in the various embodiments herein can be added, exchanged, and/or eliminated so as to provide a number of additional embodiments of the present disclosure. In addition, as will be appreciated, the proportion and the relative scale of the elements provided in the figures are intended to illustrate certain embodiments of the present invention, and should not be taken in a limiting sense.

FIG. 1 is an illustration of an example of a system 100 for multi-sided winding according to the present disclosure. In some embodiments, the system 100 can include dereeling components such as a spool 112, a wire 114 wound onto the spool 112, a dereeler axle 118, and a dereeling control unit 120. While the wire 114 is illustrated as winding off a side of the spool 112, embodiments are not so limited. For example, the wire 114 can be wound off an end of the spool 112 and/or be dereeled from an inside of the spool 112. The dereeling components can be referred to as a "dereeler." The dereeler axle 118 can rotate in order to dereel the wire 114 off of the spool 112 and onto a multi-sided object 116. The wire 114 can be wound off of the spool 112 at an angle that is perpendicular to an axis of the axle 118, as illustrated. In some embodiments, the spool 112 rotates freely about the dereeler axle 118 and tension on the wire 114 causes the spool 112 to rotate and unwind wire 114 off of the spool 112. In some embodiments, the dereeler axle 118 can rotate the spool 112 to unwind the wire 114 off of the spool 112. The rotation of the dereeler axle 118 and/or the spool 112 can be coordinated with tension on the wire 114 such that the wire 114 winds off of the spool 112 while the wire's tension remains substantially constant and the wire 114 remains taut. In some embodiments, the dereeling control unit 120 can control a speed and direction of rotation of the dereeler axle 118 of the spool 112. In some embodiments, the dereeler axle 118 may not rotate and the spool 112 can rotate about the dereeler axle 118.

The dereeling control unit 120 can control the rotating of the dereeler axle 118 to dereel the wire 114 off of the spool 112. The system 100 can use different wires 114 of a number of different gauges and/or lengths. Smaller gauges of wire (e.g., wires with greater diameters) can be wound around the multi-sided object 116 fewer times to complete a winding of the wire across one side of the multi-sided object. Larger gauges of wire (e.g., wires with smaller diameters) can be wound around the multi-sided object 116 a greater number of times to complete a winding across one longitudinal length of the multi-sided object 116.

The system 100 can include winding components 102 such as a shaft 130, a positioning component 122 (e.g., a rod), a receiving component 124 (e.g., a cone), and a cylinder 126 coupled to the receiving component 124 (e.g., a component that receives the rod, as illustrated). The positioning component 122 can position the multi-sided object 116 to maintain a particular position while being wound. The receiving component 124 can receive the positioning component 122. The winding components 102 can be controlled and/or rotated by a winding control unit 132. The shaft 130 can rotate, illustrated by arrow 134, about a longitudinal axis 136 of both the shaft 130 and the multi-sided object 116. The winding control unit 132 can rotate the shaft 130 and can be positioned on a flat surface, such as a table. As the shaft 130 rotates, the cylinder 126 and the receiving component 124 also rotates about the same longitudinal axis 136. The cylinder 126 includes a fastener 128 that couples (e.g., immovably fastens, connects, etc.) the receiving component 124 to the cylinder 126. The fastener 128 can be a screw, a pin, and/or any other tightening or securing component. When fastener 128 is tightened, the receiving component 124 is immovable in relation to the cylinder 126 and therefore immovable in relation to the shaft 130.

The receiving component 124 can receive the positioning component 122 through an opening in the receiving component 124. The positioning component 122 can be fastened to the receiving component 124 using the fastener 128. As the receiving component 124 rotates about the longitudinal axis 136, the positioning component 122 that is fastened within the receiving component 124 also rotates. As the positioning component 122 rotates, the wire 114 can be dereeled off of the spool 112 and be wound onto the multi-sided object 116 as the multi-sided object 116 rotates, as illustrated by arrow 115. As the wire 114 is wound onto the multi-sided object 116, the dereeler axle 118 can move from side to side, illustrated by arrow 138 in order to move the wire 114 from a first edge of the sides of the multi-sided object 116 being wound onto toward a second edge of the sides.

As will be described and illustrated in association with FIGS. 2A-4B, the wire 114 can be wound onto the multiple sets of sides of the multi-sided object 116 without removing the multi-sided object 116 from the positioning component 122 and/or without removing the multi-sided object 116 from any such component and/or mechanism that holds the multi-sided object 116 in place for winding. For example, the six sides of a cube can be wound onto without removing the cube from a component (e.g., positioning component 122) that holds the cube while winding. For example, the wire 114 can be wound onto a first set of sides (e.g., four sides) of the multi-sided object 116 and then the multi-sided object 116 can be repositioned without removing the multi-sided object 116 from the positioning component 122, as described below, to wind the wire 114 onto a second set of sides (e.g., four sides). That is, the wire can be wound onto a set (e.g., four sides) of the total quantity of sides (e.g., six sides) of the multi-sided object 116.

The dereeling control unit 120 can control the side-to-side traversal, illustrated as arrow 138, of the wire 114 by moving the spool 112 from side-to-side a particular distance at a particular rate depending on winding factors (e.g., size of the wire, size of the multi-sided object, etc.). One winding factor is a width of the wire 114. For example, the dereeling axle 118 can be moved, and therefore the spool 112 can be moved, a larger distance side-to-side when winding a wire with a greater width in order to line each loop around the multi-sided object 116 for each rotation of the multi-sided object 116. Vice versa, the spool 112 can move a shorter distance from side-to-side when winding a wire 114 with a lesser diameter onto a multi-sided object 116 due to the wire 114 covering a lesser portion of the multi-sided object in one loop around the multi-sided object during one rotation.

Another winding factor is a width of the multi-sided object 116. The greater the width of the multi-sided object, the slower the dereeling axle 118 moves, as indicated by arrow 138, to complete one loop of the wire around the multi-sided object. This is due to a greater distance along the width of each side taking a greater period of time to travel along and therefore the movement, as indicated by arrow 138, accounts for this greater travel time. In the alternative, the smaller the width of the multi-sided object 116, the faster the dereeling axle 118 moves, as indicated by arrow 138, to complete one loop. The above mentioned speeds are in relation to a constant speed of rotation.

Another winding factor is a speed of rotation of the shaft 130 and therefore the multi-sided object 116. If the speed of rotation is altered, the speeds at which the dereeling axle 118 moves, as indicated by arrow 138, may be affected. For example, a greater rotation speed can cause a speed at which the dereeling axle 118 will move, as indicated by arrow 138, to increase. However, the relative speeds (i.e., faster for smaller widths of the multi-sided object 116 and slower for a greater width of the multi-sided object) remains the same.

Figure 2:
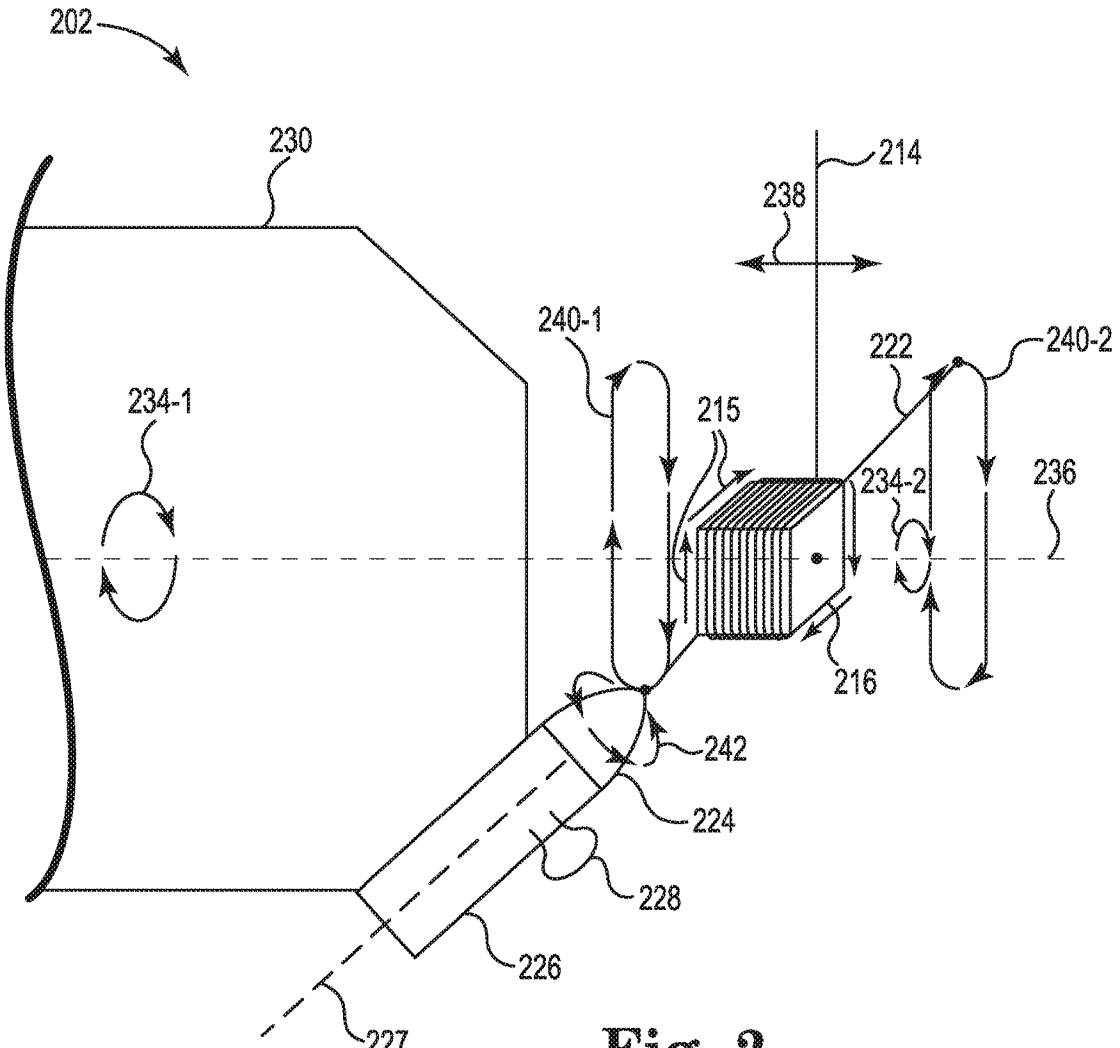
FIG. 2 is an illustration of an example of winding components according to the present disclosure.

FIG. 2 is an illustration of an example of winding components 202 according to the present disclosure. The winding components 202 can be the same as the winding components 102 illustrated in FIG. 1. In some embodiments, a shaft 230 can rotate, as illustrated by arrow 234-1, around a longitudinal axis 236 of the shaft 230. A cylinder 226 can be immovably coupled to the shaft 230 such that a rotational speed of the shaft 230 causes an equal rotational speed of the cylinder 226. Likewise, a receiving component 224 (e.g., a cone that receives the rod, as illustrated) is coupled to the cylinder 226 such that as the shaft 230 and the cylinder 226 rotate, the receiving component 224 rotates around the longitudinal axis 236 of the shaft 230. The receiving component 224 can be fastened using a fastener 228 to be immovably coupled to the cylinder 226 and detachable from the cylinder 226 when the fastener 228 is loosened and/or removed.

The receiving component 224 can be configured to receive a positioning component 222 (e.g., a rod) such that the positioning component 222 is immovably coupled to the receiving component 224. A multi-sided object 116 such as a cube can be slid and/or inserted onto the positioning component 222 such that the positioning component 222 passes through a first corner of the multi-sided object 216 and exits a second corner of the multi-sided object 216 that is furthest from and opposite the first corner. The positioning component 222 can be received by the receiving component 224 at a particular angle such that when the positioning component 222 is rotated, along with the rotating shaft 230, cylinder 226, and receiving component 224, a center point of the multi-sided object 216 maintains a position along the longitudinal axis 236 of the shaft 230 while the multi-sided object 216 rotates around the longitudinal axis 236 of the shaft 230.

As the positioning component 222 rotates around the longitudinal axis 236 of the shaft 230, a first point at which the positioning component 222 enters the receiving component 224 rotates around the longitudinal axis 236 of the shaft 230 in a first orbit 240-1. Further, a second point of the positioning component 222 furthest from the receiving component 224 rotates around the longitudinal axis 236 of the shaft 230, indicated by arrow 234-2, in a second orbit 240-2. The rotating of the multi-sided object 216 on the positioning component 222 causes the wire 214 to be wound, indicated by arrows 215 (including each of four arrows illustrated indicating winding around each of the four sides of the cube), around the multi-sided object 216. The wire 214 can be moved, indicated by arrow 238, from right to left, as illustrated, in order to wind the wire 214 from a first edge of each of a first set of sides of the multi-sided object 216 to a second edge of each of the first set of sides that are each opposite their corresponding first edge. That is, wound from a left edge of each side of the first set of sides of the illustrated cube to a right edge of each side of the first set of sides of the cube.

A first set of four sides, described further below in association with FIGS. 3A-3C, can be wound while the multi-sided object 216 is in a particular position. To move the multi-sided object 216 to an additional position, the fastener 228 can be loosened and/or removed and the receiving component 224 can be rotated, as indicated by arrows 242, about an axis of the receiving component 224 and the cylinder 226. In some embodiments, the receiving component 224 can be rotated a particular number of degrees (e.g., 120 degrees) around a longitudinal axis 227 of the receiving component 224 to line up an additional set of four sides for winding (as described further below in relation to transitioning from FIG. 3A to 3B and from FIG. 3B to 3C). Then, the fastener 228 can be tightened and/or reinserted to fasten the receiving component 224 to the cylinder 226 so that wire can be wound onto the additional set of four sides. While the above example is in relation to a cube with six sides and the receiving component 224 is illustrated as rotating 120 degrees for each set of sides, embodiments are not so limited. For example, a multi-sided object can be a prism including more or fewer than six sides, which may require a different amount of rotation for each set of sides to be wound.

While the winding components 202 are illustrated as including a shaft, a cylinder, a receiving component, and a rod, embodiments are not so limited. For example, the winding components 202 can include fewer components than are illustrated to wind the wire 214 around all sides of the multi-sided object 216. The winding components 202 can include any number of components that rotate the multi-sided object 216 around the longitudinal axis 236 of the shaft 230 and also rotate, as illustrated at arrow 242, the multi-sided object 216 a particular number of degrees around the longitudinal axis 227 to line up a different set of sides to wind onto. In addition, the rod can be replaced by an additional mechanism to hold the multi-sided object 216 and still be able to accomplish these outcomes. For example, instead of a rod (as illustrated), the positioning component can be a mechanism that holds each of the opposite corners without passing through the multi-sided object. That is, the mechanism could use tension to hold each opposite corner to hold the multi-sided object in a particular position while being wound. As long as the mechanism accomplishes holding the multi-sided object to be wound onto in the way illustrated, the mechanism can be referred to as a positioning and/or winding component, as described herein.

Figures 3A, 3B, 3C:
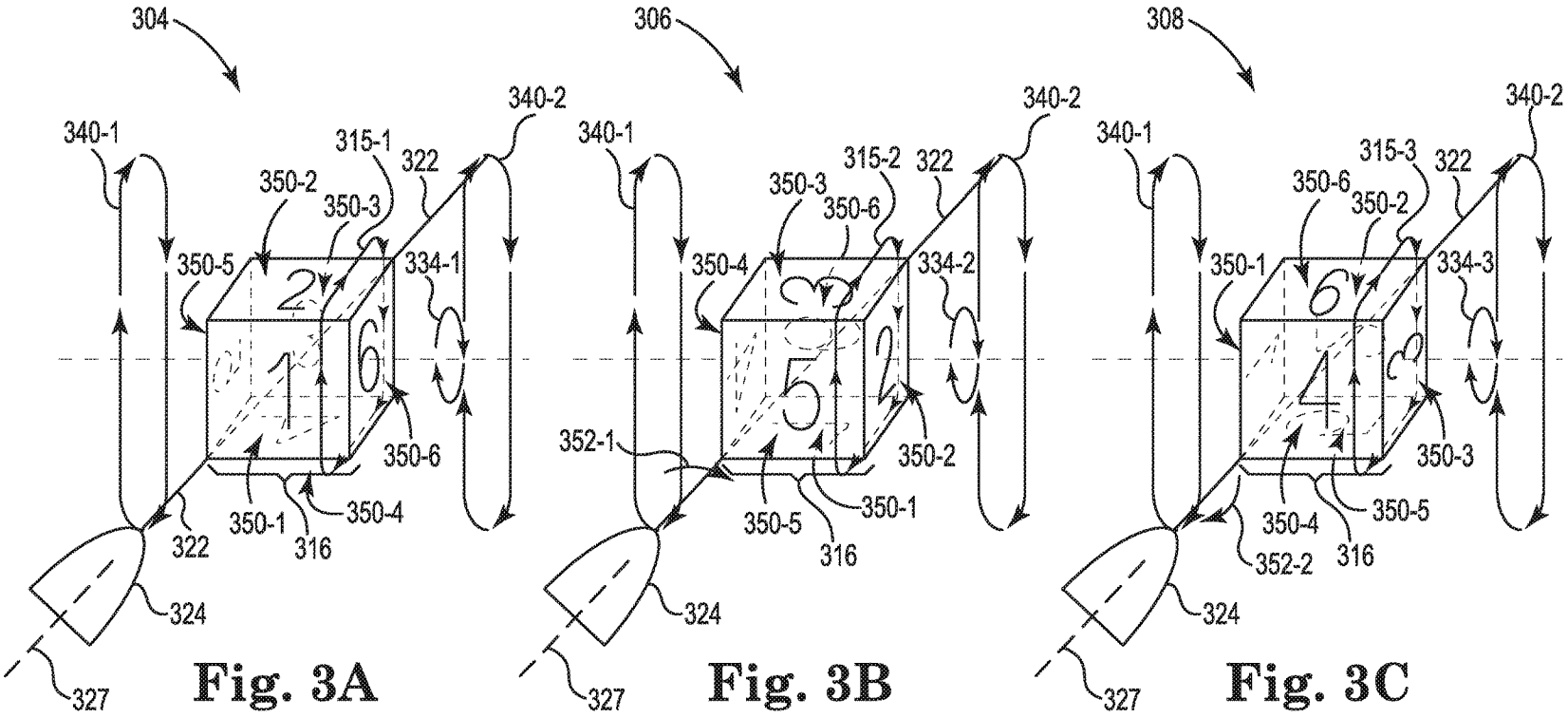
FIG. 3A is an illustration of an example of a multi-sided object in a first position according to the present disclosure.
FIG. 3B is an illustration of an example of a multi-sided object in a second position according to the present disclosure.
FIG. 3C is an illustration of an example of a multi-sided object in a third position according to the present disclosure.

FIG. 3A is an illustration of an example of a multi-sided object in a first position according to the present disclosure. The first position 304 includes a multi-sided object 316 being received on a positioning component 322 (e.g., a rod). The positioning component 322 is inserted into a receiving component 324 (e.g., a component that receives the rod, as illustrated). The multi-sided object 316 includes six sides 350-1, 350-2, 350-3, 350-4, 350-5, 350-6, each illustrated by numbers "1," "2," "3," "4," "5," and "6," respectively. The first position 304 as illustrated in FIG. 3A includes a first set of four sides 350-1, 350-2, 350-3, 350-4 (e.g., first side "1," second side "2," third side "3," and fourth side "4"). The first set of sides 350-1, 350-2, 350-3, 350-4 are positioned to have a wire (e.g., wire 116 and 216 in FIGS. 1 and 2) wound there around as illustrated by arrow 315-1. That is, the wire is not wound onto a fifth side (e.g., "5") and a sixth side (e.g., "6") while the multi-sided object 316 is in the first position 304 illustrated in FIG. 3A. The multi-sided object 316 is rotated such that the wire is wound onto the first set of sides 350-1, 350-2, 350-3, 350-4. Each set of sides of the multi-sided object 316 is rotated around the longitudinal axis (e.g., a same longitudinal axis as the longitudinal axis 236 of the shaft in FIG. 2) of the multi-sided object 316 equidistantly as illustrated by arrow 334-1. That is, each of the four sides that are being wound around is equally distant from the longitudinal axis 236 as shown in FIG. 2.

FIG. 3B is an illustration of an example of a multi-sided object in a second position according to the present disclosure. In order to reposition the multi-sided object 316 from the first position (304 illustrated in FIG. 3A) to the second position 306, a receiving component 324 can be rotated, as indicated by arrow 352-1. While a receiving component 324 is illustrated in this example, embodiments are not so limited. For example, in some embodiments, any component that positions the multi-sided object 316 to wind around a first set of sides (e.g., as illustrated in FIG. 3A) and repositions to wind around a second set of sides (e.g., as illustrated in FIG. 3B) can be used. The rotation from the first position to the second position can include rotating the receiving component 324 a particular number of degrees (e.g., 120 degrees) clockwise around the longitudinal axis 327 of the receiving component 324, and therefore the multi-sided object 316 and positioning component 322 are also rotated, as illustrated by arrow 334-2, a particular amount around a longitudinal axis 327 of the receiving component 324. The multi-sided object 316 can be repositioned from the first position to the second position without removing the multi-sided object from the positioning component 322.

As illustrated in FIGS. 3A and 3B, and only by way of example in regards to the particular illustration of the figures, rotating a particular number of degrees (e.g., 120 degrees) to go from the first position 304 to the second position 306 includes the first side "1" 350-1 rotating from a front side in FIG. 3A to a bottom side in FIG. 3B. The second side "2" 350-2 is rotated from a top side to a right side. The sixth side "6" 350-6 is rotated from a right side to a back side. The third side "3" 350-3 is rotated from a back side to a top side. The fifth side "5" 350-5 is rotated from a left side to a front side. The fourth side "4" 350-4 is rotated from a bottom side to a left side. Therefore, the wire (e.g., wire 214 in FIG. 2) goes from being wound around a first set of sides (including the first, second, third, and fourth sides, 350-1, 350-2, 350-3, 350-4, respectively in FIG. 3A) to being wound around a second set of sides (including the first, fifth, third, and sixth sides, 350-1, 350-5, 350-3, 350-6, respectively, in order of rotation around the multi-sided object 316 in FIG. 3B). That is, while the multi-sided object 316 is in the second position 306, wire is not wound onto the second and fourth sides 350-2 and 350-4.

Subsequent to rotation of the receiving component 324, the receiving component 324 can be fastened by a fastener (e.g., fastener 228) to hold the receiving component 324 in place. As illustrated by arrow 315-2, wire can be wound onto a second set of sides (e.g., sides "5" 350-5, "3" 350-3, "6" 350-6, and "1" 350-1) of the multi-sided object 316 while the multi-sided object is in the second position 306.

FIG. 3C is an illustration of an example of a multi-sided object in a third position according to the present disclosure. In order to reposition the multi-sided object 316 from the second position (206 illustrated in FIG. 3B) to the third position 308, a receiving component 324 can be rotated, as indicated by arrow 352-2. The rotation from the second position 306 to the third position 308 can include rotating the receiving component 324 a particular number of degrees (e.g., 120 degrees) clockwise around the longitudinal axis 327 of the receiving component 324, and therefore the multi-sided object 316 and positioning component 322 are also rotated, as illustrated by arrow 334-3, a particular amount around a longitudinal axis 327 of the receiving component 324.

As illustrated in FIGS. 3B and 3C, and only by way of example in regards to the particular illustration of the figures, rotating a particular number of degrees (e.g., 120 degrees) to go from the second position to the third position includes the fifth side "5" 350-5 rotating from a front side in FIG. 3B to a bottom side in FIG. 3C. The third side "3" 350-3 is rotated from a top side to a right side. The second side "2" 350-2 is rotated from a right side to a back side. The sixth side "6" 350-6 is rotated from a back side to a top side. The fourth side "4" 350-4 is rotated from a left side to a front side. The first side "1" 350-1 is rotated from a bottom side to a left side. Therefore, the wire (e.g., wire 214 in FIG. 2) goes from being wound around a second set of sides (including the fifth, third, sixth, and first sides, 350-5, 350-3, 350-6, 350-1, respectively, and in order of rotation around the multi-sided object 316 in FIG. 3B) to being wound around a third set of sides (including the fourth, sixth, second, and fifth sides, 350-4, 350-6, 350-2, 350-5, respectively, in order of rotation around the multi-sided object 316 in FIG. 3C). That is, while the multi-sided object 316 is in the third position 308, wire is not wound onto the first and third sides 350-1 and 350-3. The multi-sided object 316 can be repositioned from the first position 304 to the second position 306 and from the second position 306 to the third position 308 without removing the multi-sided object from the positioning component 322. While rotations are illustrated as rotating in a clockwise direction when looking toward the illustrated right side of the multi-sided object 316, rotations are not so limited. For example, the multi-sided object 316 can rotate in a counterclockwise direction when looking toward the illustrated right side of the multi-sided object 316. An end of the positioning component 322 more proximal to the receiving component 324 can have a rotation 340-1 and a distal end of the receiving component 324 can have a rotation 340-2 such that when the proximal end is at the bottom of the rotation 340-1 as illustrated the distal end is at the top of the rotation 340-2, and vice versa.

Figures 4A, 4B, 4C:
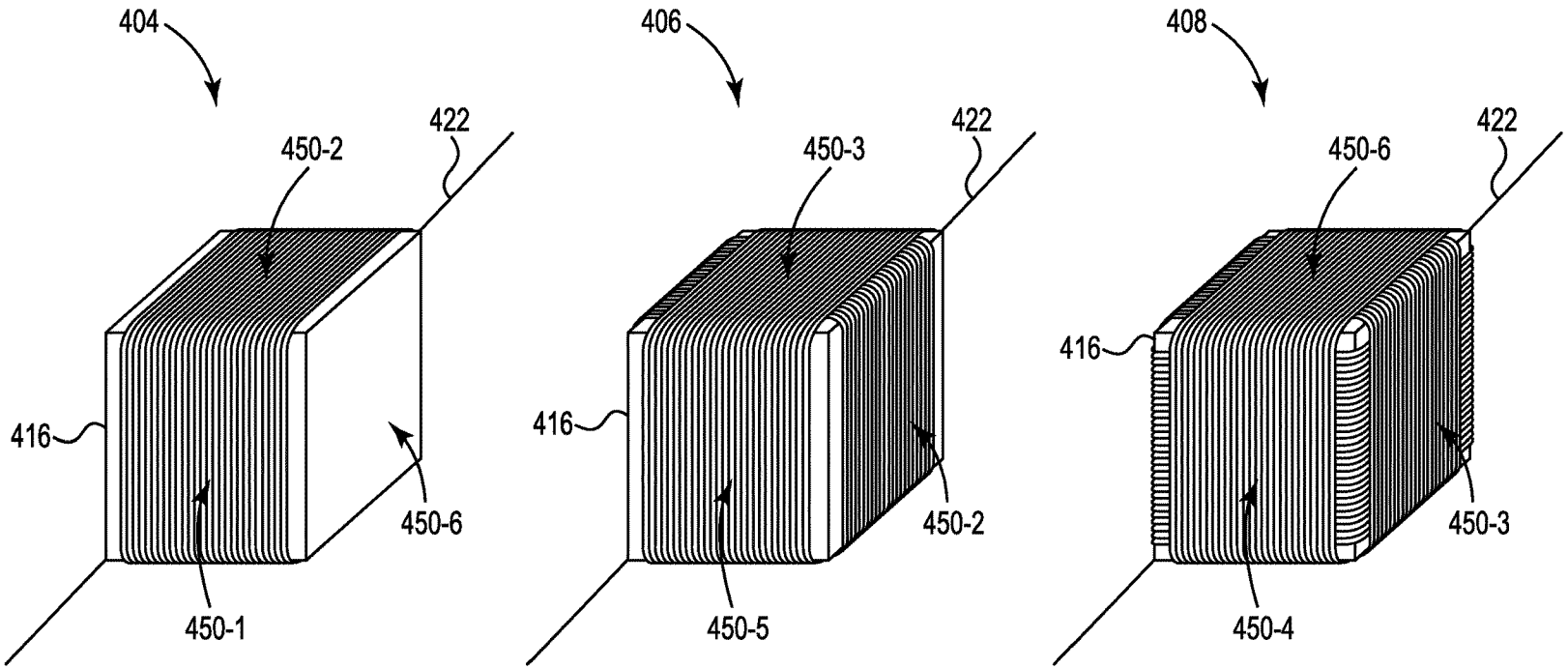
FIGS. 4A-4C are each an illustration of an example of multi-sided winding according to the present disclosure.

FIGS. 4A-4C are each an illustration of an example of multi-sided winding according to the present disclosure. FIG. 4A is an illustration of a wire wound around the first set of sides (e.g., the first 450-1, second 450-2, third, and fourth sides, hidden sides not labeled for illustration purposes) of the multi-sided object 316. The wire wound onto the multi-sided object 416 in FIG. 4A corresponds to FIG. 3A. In FIG. 4A, the multi-sided object 416 has been received by a positioning component 422 (e.g., a rod) through two furthest and opposite corners of the multi-sided object 416.

FIG. 4B is an illustration of a wire wound around the second set of sides (e.g., the fifth 450-5, third 450-3, sixth, and first sides) of the multi-sided object 316. The wire wound onto the multi-sided object 416 in FIG. 4B corresponds to FIG. 3B. That is, the wire would already have been wound around the first set of sides before being wound around the second set of sides as illustrated by the winding of FIG. 4B overlapping the winding illustrated in FIG. 4A.

FIG. 4C is an illustration of a wire around the third set of sides (e.g., the fourth 450-4, sixth 450-6, second, and fifth sides) of the multi-sided object 316. The wire wound onto the multi-sided object 416 in FIG. 4C corresponds to FIG. 3C. The wire would already have been wound around the first and the second sets of sides before being wound around the third set of sides as illustrated by the winding of FIG. 4C overlapping the windings illustrated in both FIG. 4A and FIG. 4B. In this way, all sides of the multi-sided object (e.g., the six sides of a cube, as illustrated) would be wound onto without removing the multi-sided object from the winding component (e.g., without removing from the positioning component 422 in this example).

Although specific embodiments have been illustrated and described herein, those of ordinary skill in the art will appreciate that an arrangement calculated to achieve the same results can be substituted for the specific embodiments shown. This disclosure is intended to cover adaptations or variations of a number of embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the number of embodiments of the present disclosure includes other applications in which the above structures and methods are used. Therefore, the scope of a number of embodiments of the present disclosure should be determined with reference to the appended claims, along with the full range of equivalents to which such claims are entitled.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for winding, comprising:

positioning a multi-sided object on a receiving component coupled to a rotating shaft, wherein the multi-sided object is in a first position with respect to the rotating shaft;

dereeling a wire from a dereeler and winding onto the multi-sided object in the first position;

rotating the receiving component to position the multi-sided object in a second position with respect to the rotating shaft without removing the multi-sided object from the receiving component; and dereeling the wire from the dereeler and winding onto the multi-sided object in the second position.

2. The method of claim 1, wherein dereeling the wire onto the multi-sided object in the first position comprises dereeling the wire and winding onto a set of sides of the multi-sided object.

3. The method of claim 2, wherein the set of sides includes four sides and the multi-sided object includes six total sides.

4. The method of claim 1, wherein rotating from the first position to the second position comprises rotating the receiving component 120 degrees.

5. The method of claim 1, comprising:

rotating the receiving component to position the multi-sided object in a third position without removing the multi-sided object from the receiving component; and dereeling the wire from the dereeler and winding onto the multi-sided object in the third position.

6. The method of claim 5, wherein dereeling the wire onto the multi-sided object in the first position comprises dereeling the wire and winding across a first side, a second side, a third side, and a fourth side of the multi-sided object.

7. The method of claim 6, wherein dereeling the wire onto the multi-sided object in the second position comprises dereeling the wire and winding across the first side, the third side, a fifth side, and a sixth side of the multi-sided object.

8. The method of claim 7, wherein dereeling the wire onto the multi-sided object in the third position comprises dereeling the wire and winding across the second side, the fourth side, the fifth side, and the sixth side of the multi-sided object.

9. A method for winding, comprising:

winding a wire onto a first set of sides of a multi-sided object while the multi-sided object is coupled to a receiving component, wherein the receiving component is coupled to a rotating shaft and the multi-sided object is in a first position with respect to the rotating shaft while winding onto the first set of sides; and winding the wire onto a second set of sides of the multi-sided object while the multi-sided object is in a second position with respect to the rotating shaft, having been rotated from the first position; and winding the wire onto a third set of sides of the multi-sided object while the multi-sided object is in a third position with respect to the rotating shaft, having been rotated from the second position;

wherein the multi-sided object is not removed from the receiving component when the multi-sided object is rotated from the first to the second position and from the second to the third position.

10. The method of claim 9, wherein:

the first set of sides includes a first side, a second side, a third side, and a fourth side of the multi-sided object;

the second set of sides includes the first side, the third side, a fifth side, and a sixth side; and the third set of sides includes the second side, the fourth side, the fifth side, and the sixth side.

11. The method of claim 9, comprising rotating the receiving component:

120 degrees to rotate the multi-sided object from the first position to the second position; and 120 degrees to rotate the multi-sided object from the second position to the third position.

12. The method of claim 9, wherein winding the wire onto the first set of sides of the multi-sided object comprises dereeling the wire off a dereeler and onto the first set of sides by rotating the multi-sided object.

13. A winding system, comprising:

a dereeler configured to dereel a wire wound therearound;

a shaft positioned a particular distance from the dereeler and configured to rotate about a longitudinal axis of the shaft, wherein the longitudinal axis of the dereeler is perpendicular to a direction that the wire is dereeled off the dereeler;

a receiving component coupled to the shaft at an angle such that an axis of the receiving component is non-colinear with the longitudinal axis of the shaft;

a positioning component coupled to the receiving component and configured to hold a multi-sided object at a particular position;

wherein the angle is such that the wire is wound onto a first set of sides of the multi-sided object in response to the shaft rotating; and wherein the receiving component is configured to rotate a number of degrees about a longitudinal axis of the receiving component such that the wire is wound onto a second set of sides of the multi-sided object in response to the shaft rotating.

14. The winding system of claim 13, wherein the positioning component is a rod configured to slide into the multi-sided object comprising a cube, through the axis from a first corner to a second corner that is most distant from the first corner of the cube.

15. The winding system of claim 14, wherein:

the first set of sides of the cube comprises a first side, a second side, a third side, and a fourth side of the cube; and the second set of sides of the cube comprises the first side, the third side, a fifth side, and a sixth side of the cube.

16. The winding system of claim 13, wherein the receiving component is configured to rotate 120 degrees about the longitudinal axis of the receiving component.

17. The winding system of claim 13, comprising a fastener to immovably couple the receiving component to the shaft.

18. The winding system of claim 17, wherein the fastener is loosened to rotate the receiving component about the longitudinal axis of the receiving component.

19. The winding system of claim 13, wherein the dereeler is configured to move in a direction parallel to the longitudinal axis of the shaft to move the wire in a direction from a first edge of the first set of sides towards an opposite edge of the first set of sides.

20. The winding system of claim 13, wherein the shaft is configured to rotate such that the first set of sides are spun around an axis of the shaft equidistantly.

* * * * *